US008087531B1

(12) United States Patent
Riemer

(10) Patent No.: US 8,087,531 B1
(45) Date of Patent: Jan. 3, 2012

(54) ANTI-SPLASH/SPILL CONTAINER LID

(76) Inventor: J. Derek Riemer, Westford, MA (US)

( * ) Notice: Subject to any disclaimer, the term of this patent is extended or adjusted under 35 U.S.C. 154(b) by 615 days.

(21) Appl. No.: 12/217,348

(22) Filed: Jul. 3, 2008

(51) Int. Cl.
*B65D 51/18* (2006.01)

(52) U.S. Cl. ..... 220/254.5; 220/254.7; 215/387; 229/404

(58) Field of Classification Search ..... 220/254.5, 220/254.2, 254.1, 203.12, 787, 789, 800, 220/801, 307, 254.4, 254.6, 254.7, 714, 713, 220/717, 256.1; 215/387; 229/404
See application file for complete search history.

(56) References Cited

U.S. PATENT DOCUMENTS 6,626,314 B1 * 9/2003 McHenry et al. ..... 220/254.2
2003/0089714 A1 * 5/2003 Dart et al. ..... 220/254.3
* cited by examiner

*Primary Examiner* — Jacob K Ackun
*Assistant Examiner* — Kareen Rush
(74) *Attorney, Agent, or Firm* — Joseph Stecewycz

(57) ABSTRACT

A container lid for dispensing a pourable substance is disclosed, the lid comprising a flexible closure tab having a snap, a lid opening closure, an opening actuator disposed on a planar cantilever section of the flexible closure tab between the snap and the lid opening closure; a lid base having a snap receptacle for releasably retaining the snap, a lid opening for receiving the lid opening closure, and an actuator guide cutout for enclosing the opening actuator.

14 Claims, 14 Drawing Sheets

ANTI-SPLASH/SPILL CONTAINER LID

FIELD OF THE INVENTION

The present invention relates to container lids and, more particularly, to anti-spill and anti-splash container lids.

BACKGROUND OF THE INVENTION

Various types of covers or lids are known in the present state of the art for providing closure to containers while allowing for selective dispensing of liquids or other pourable substances. For example, U.S. Pat. No. 4,138,033, "Liquid container lid," discloses a lid for a beverage container, the lid having large opening for dispensing a drinking liquid and for allowing the passage of air as the liquid is dispensed. U.S. Pat. No. 4,190,174, "Drinking receptacle cover with a lip operated valve," discloses a lid having a valve formed from two layers so as to increase the elastic memory of the valve. U.S. Pat. No. 5,076,972, "Self-closing beverage lid," is another lid configuration in which a spring is incorporated to provide for sealing bias. More recently, U.S. Published Application No. 2008/0000920, "Low cost spill-resistant cup for liquids," claims a cup for dispensing liquids and resisting spillage, the cup comprising a scoop-like baffle and a push tab for creating an opening when pushed. However, most of the container lids taught in the present art present manufacturing complexities while failing to provide a reliable anti-spill and anti-splash feature.

BRIEF SUMMARY OF THE INVENTION

In one aspect of the present invention, a container lid comprises a flexible closure tab having a snap; a lid opening closure; an opening actuator disposed on a planar cantilever section of the flexible closure tab between the snap and the lid opening closure; a lid base having a snap receptacle for releasably retaining the snap; a lid opening for receiving the lid opening closure; and an actuator guide cutout for enclosing the opening actuator.

In another aspect of the present invention, a container lid comprises a flexible closure tab having a lid opening closure disposed on the flexible closure tab; an opening actuator disposed on the flexible closure tab proximate the lid opening closure; a lid base having a top ridge extending between an outer conical surface and an inner conical surface, the inner conical surface enclosing a generally planar, substantially circular, depressed interior surface; means for securing a second end of the flexible closure tab to the depressed interior surface; a lid opening in the top ridge for receiving the lid opening closure; and an actuator guide cutout in the depressed interior surface for enclosing the opening actuator whereby the lid opening closure may be moved from the lid opening by application of a force to the opening actuator.

In another aspect of the present invention, a method for dispensing a pourable substance through a container lid comprises the steps of: providing a lid opening closure for a lid opening, the lid opening disposed in a top ridge of the container lid; providing an opening actuator mechanically coupled to the lid opening closure, the opening actuator including a substantially convex surface protruding through a generally planar, substantially circular, depressed interior surface in the container lid; providing a pivot point mechanically coupled to the opening actuator; and applying an actuating force to the opening actuator to move the lid opening closure into the container.

The additional features and advantage of the disclosed invention is set forth in the detailed description which follows, and will be apparent to those skilled in the art from the description or recognized by practicing the invention as described, together with the claims and appended drawings.

BRIEF DESCRIPTIONS OF THE DRAWINGS

The foregoing aspects, uses, and advantages of the present invention will be more fully appreciated as the same becomes better understood from the following detailed description of the present invention when viewed in conjunction with the accompanying drawings, in which.

DETAILED DESCRIPTION OF THE INVENTION

The following detailed description is of the best currently contemplated modes of carrying out the invention. The description is not to be taken in a limiting sense, but is made merely for the purpose of illustrating the general principles of the invention, since the scope of the invention is best defined by the appended claims. Those skilled in the art will appreciate that the conception upon which the disclosure below is based may readily be utilized as a basis for designing other products. For example, container lids as disclosed and claimed are not limited to the materials described herein, and the size, shape, and features of the closure and other components can be modified without departing from the spirit of the invention.

Figure 1:
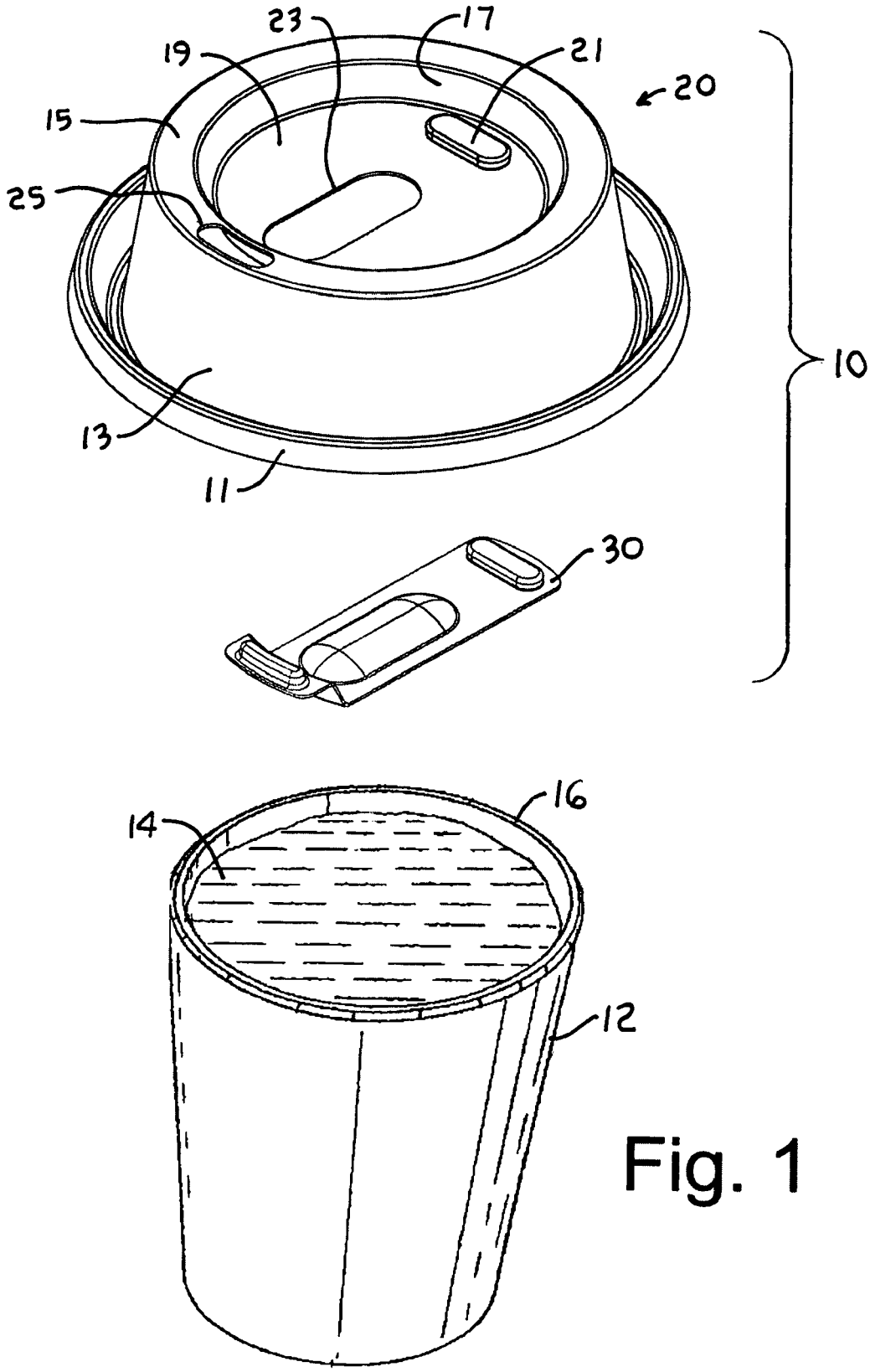
FIG. 1 is an exploded isometric diagrammatical view of a two-piece anti-splash/spill container lid, in accordance with the present invention, comprising a lid base and a flexible closure tab.

There is shown in FIG. 1, an exemplary embodiment of a two-piece anti-splash/spill container lid 10 comprising a lid base 20 and a flexible closure tab 30, in accordance with the present invention. The lid base 20 may include a downward-facing concave lid rim 11 to provide for a press-fit attachment to a container rim 16 on a container 12, and thereby retain a pourable substance 14, such as a liquid or a powder, in the container 12 without allowing an inadvertent splashing or spilling. The lid base 20 further comprises an outer, substantially conical surface 13 extending from the lid rim 11, the outer conical surface 13 having the general shape of a truncated cone. The lid base 20 further comprises an inner, substantially conical surface 17, having the general shape of a truncated cone, and a top ridge 15 extending between the inner conical surface 17 and the outer conical surface 13. The inner conical surface 17 encloses a generally planar, substantially circular, depressed interior surface 19. The lid base 20 includes a snap receptacle 21 disposed on the depressed interior surface 19, and an actuator guide cutout 23 in the depressed interior surface 19. The lid base 20 further includes a lid opening 25 in the top ridge 15 to allow for dispensing of the pourable substance 14 when desired by a user.

Figure 2:
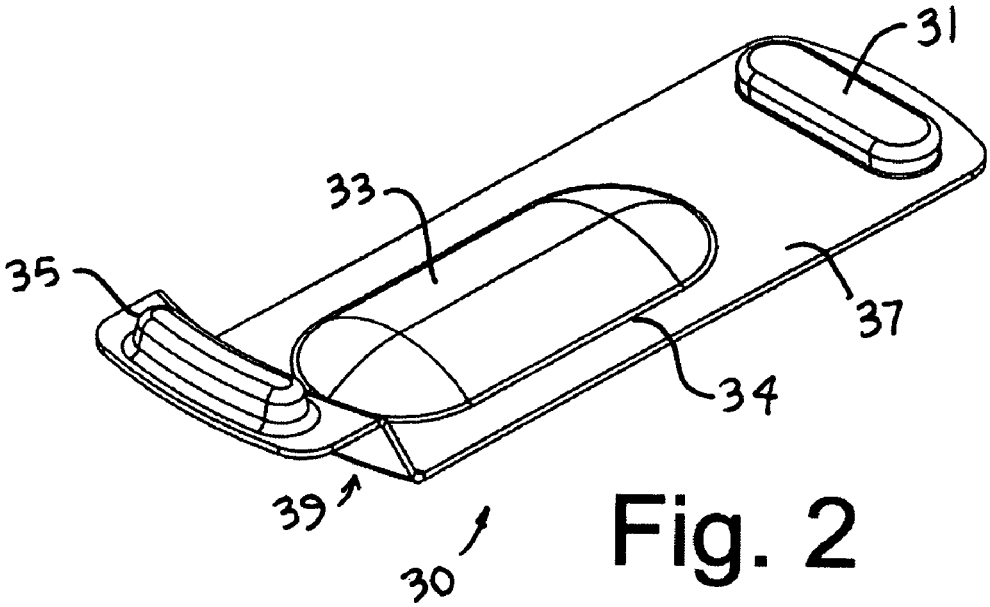
FIG. 2 is a detail isometric view of the flexible closure tab of FIG. 1.
Figure 3:
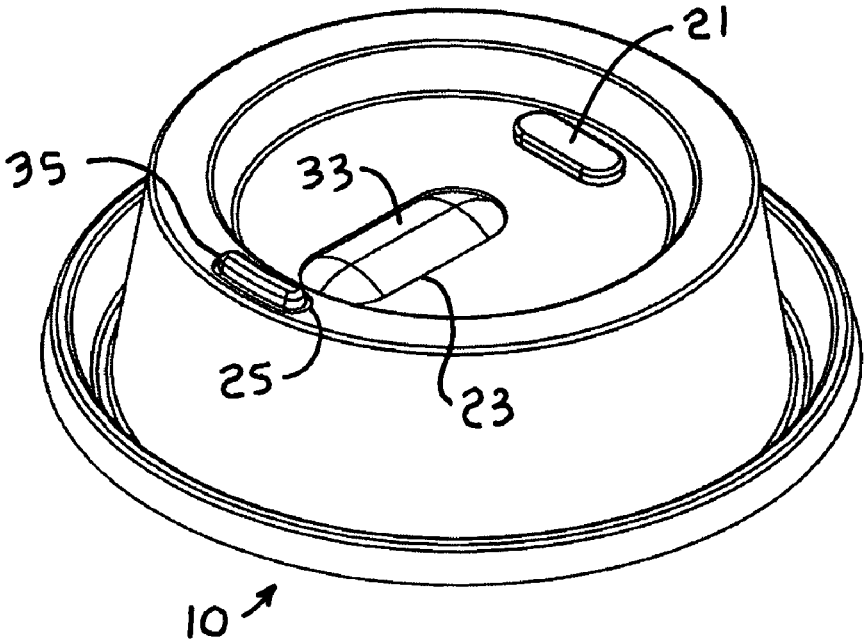
FIG. 3 is a diagrammatical isometric view of the lid base of FIG. 1 assembled with the flexible closure tab of FIG. 2.

As best shown in FIGS. 2 and 3, one end of the flexible closure tab 30 includes a snap 31 for insertion into and retention by the snap receptacle 21. The flexible closure tab 30 further comprises an opening actuator 33 configured as a substantially convex surface protruding from a cantilever section 37, the opening actuator 33 having a perimeter 34 defined on the cantilever section 37 substantially congruent with the periphery of the actuator guide cutout 23. A lid opening closure 35 is disposed at another end of the flexible closure tab 30, distal from the snap 31, the lid opening closure 35 configured as a generally tapered cylindrical surface protruding from an offset section 39 of the flexible closure tab 30, the exterior periphery of the lid opening closure 35 at the offset section 39 substantially congruent with the inside geometry of the lid opening 25 in the lid base 20. The width of the flexible closure tab 30 is preferably greater than the width of the actuator guide cutout 23 and the width of the lid opening 25 so as to ensure a seal against leakage of the pourable substance 14 through the container lid 10.

When the snap 31 is releasably secured in the snap receptacle 21, (i) the snap 31 serves as both an attachment point and a pivot point, as described in greater detail below, (ii) the opening actuator 33 protrudes through and closes off the actuator guide cutout 23 opening, and (iii) the lid opening closure 35 protrudes through and closes off the lid opening 25. The lid opening closure 35 is normally retained in a 'closed' position, that is, against the lid opening 25, by a spring-like biasing feature of the flexible closure tab 30. It can be appreciated by one skilled in the art that, if a splashing or spilling situation does occur, the splashing pourable substance 14 in the container 12 functions to urge the flexible closure tab 30 against the inside of the container lid 10, thereby effectively sealing off the lid opening 25 with the lid opening closure 35 and effectively sealing off the actuator guide cutout 23 with the opening actuator 33. In an alternative embodiment (shown in FIG. 14 below), the snap 31 and the snap receptacle 21 may not be provided. Instead, the flexible closure tab may be permanently attached to the lid base 20 by means of an adhesive, mechanical fasteners, heat staking, swaging, hydroforming, tack welds, or other fastening method as is well known in the relevant art.

In an exemplary embodiment, the container 12 may comprise a disposable cup, such as a paper or STYROFOAM® beverage cup, and the pourable substance 14 may comprise a hot liquid such as hot coffee or tea, or a cold liquid such as iced coffee or a soft drink. When the container lid 10 is removably attached to the container 12, the container rim 16 is received within the concave lid rim 11 such that the lid base 20 is frictionally retained by the container 12. In an alternative exemplary embodiment, the lid base 20 may be attached to the container 12 by using threads, a hinge, or mechanical fasteners, or the container 12 may be integrally formed with the container lid 10.

Figure 4:
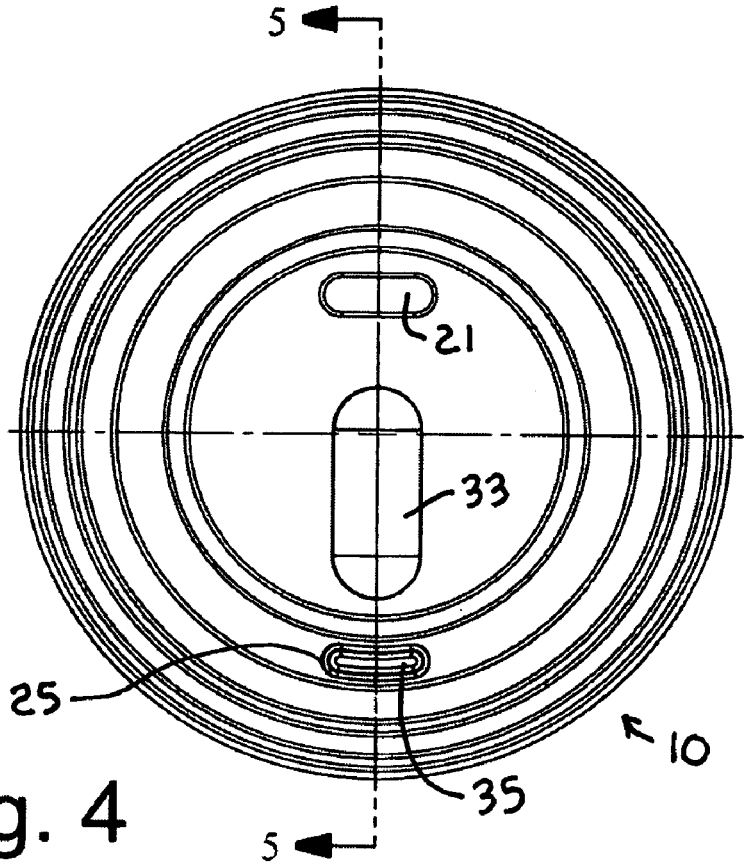
FIG. 4 is a top view of the assembled container lid of FIG. 3.
Figure 5:
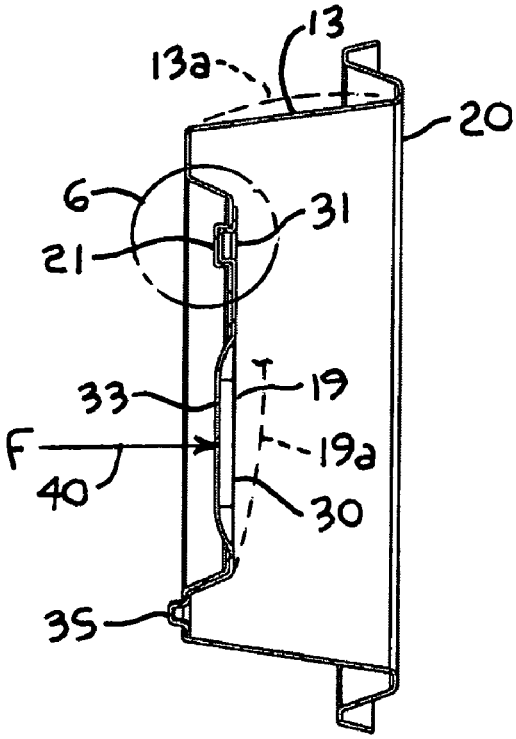
FIG. 5 is a section view of the assembled container lid of FIG. 4.

Operation of the anti-splash/spill container lid 10 can be described with reference to FIGS. 4 and 5. FIG. 5 is a cross sectional view of the container lid 10 taken through the snap receptacle 21, the opening actuator 33, and the lid opening closure 35, as indicated by section line 5-5 in FIG. 4. When a user lifts and tips the container 12 to dispense the pourable substance 14 through the lid opening 25, an actuating force F is applied against the opening actuator 33, by the user's finger or lip for example, as represented by arrow 40. The flexible closure tab 30 bends away from the lid base 20, in response to the actuating force F, by flexing proximate the snap 31 (i.e., the pivot point). When the actuating force F is removed from the opening actuator 33, the spring-like biasing feature of the flexible closure tab 30 enables the lid opening closure 35 to close off the lid opening 25 in the container lid 10.

Accordingly, by incorporating the above features in a drinking cup lid, for example, the lid may be closed without the user's assistance, and the user thus requires only one hand to hold and use the covered drinking cup. As can be appreciated by one skilled in the art, the anti-splash/spill container lid 10 may, in an alternative embodiment, comprise an outer torroidal surface 13*a* in place of the outer conical surface 13, and may comprise a domed interior surface 19*a* which can be concave (as shown) or convex (not shown) in place of the depressed interior surface 19. The container lid 10 and the flexible closure tab 30 may be fabricated using any of: plastic, rubber, paper, cardboard, or laminates of multiple materials using, for example, conventional vacuum forming, a pressing process, or cutting with a steel ruled die. The container lid 10 and the flexible closure tab 30 may further comprise an additional layer, such as a metal foil layer, a plastic layer, or a rubber layer, to increase resistance to liquids.

Figure 6:
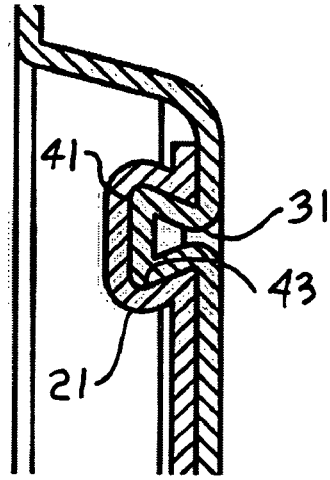
FIG. 6 is an enlarged detail view from FIG. 5 showing a flexible closure snap removably secured in a lid base snap receptacle.
Figure 7:
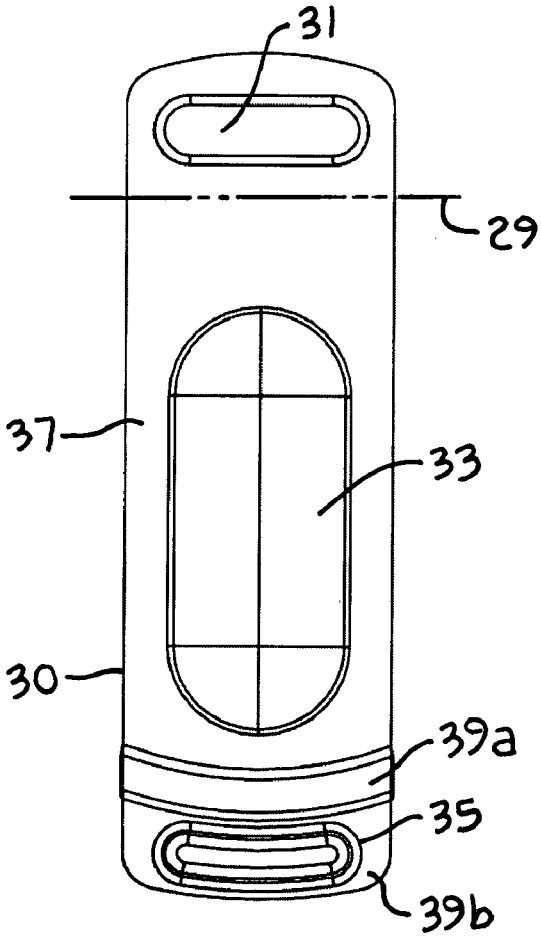
FIG. 7 is a top diagrammatical view of the flexible closure tab of FIG. 2 showing a linear bend line.

The retention of the snap 31 in the snap receptacle 21 may be seen in greater detail in FIG. 6 where, in an exemplary embodiment, the snap 31 comprises a flared tip 41 which may be removably retained by an undercut region 43 of the snap receptacle 21, the features exaggerated in the diagram for clarity of illustration. As the user applies force F (shown in FIG. 5) to the opening actuator 33 to move the lid opening closure 35 away from the lid opening 25, the flexible closure tab 30 bends inwardly on an approximately linear bend line 29 located between the snap 31 and the opening actuator 33, as shown in FIG. 7. The resilience of the cantilever action of the flexible closure tab 30 can be specified by an appropriate selection of the material flexibility and thickness used to fabricate the flexible closure tab 30.

Figure 8:
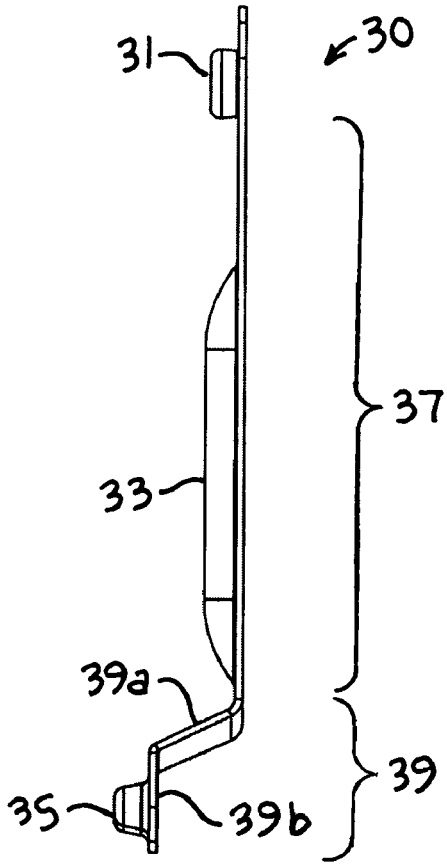
FIG. 8 is a side diagrammatical view of the closure tab of FIG. 7.

As can be seen with additional reference to FIG. 8, the offset section 39 comprises an offset arm 39*a* disposed between the cantilever section 37 and an offset base 39*b* supporting the lid opening closure 35, such that the plane of the offset base 39*b* is offset from and substantially parallel to the plane of the cantilever section 37. Accordingly, the lid opening closure 35, which is disposed on the offset base 39*b*, is offset from and substantially parallel to the opening actuator 33, which is disposed on the cantilever section 37. This configuration allows for a user to depress the opening actuator 33 with an upper lip, for example, while properly positioning the lid opening 25 for sipping the pourable substance 14.

Figure 9:
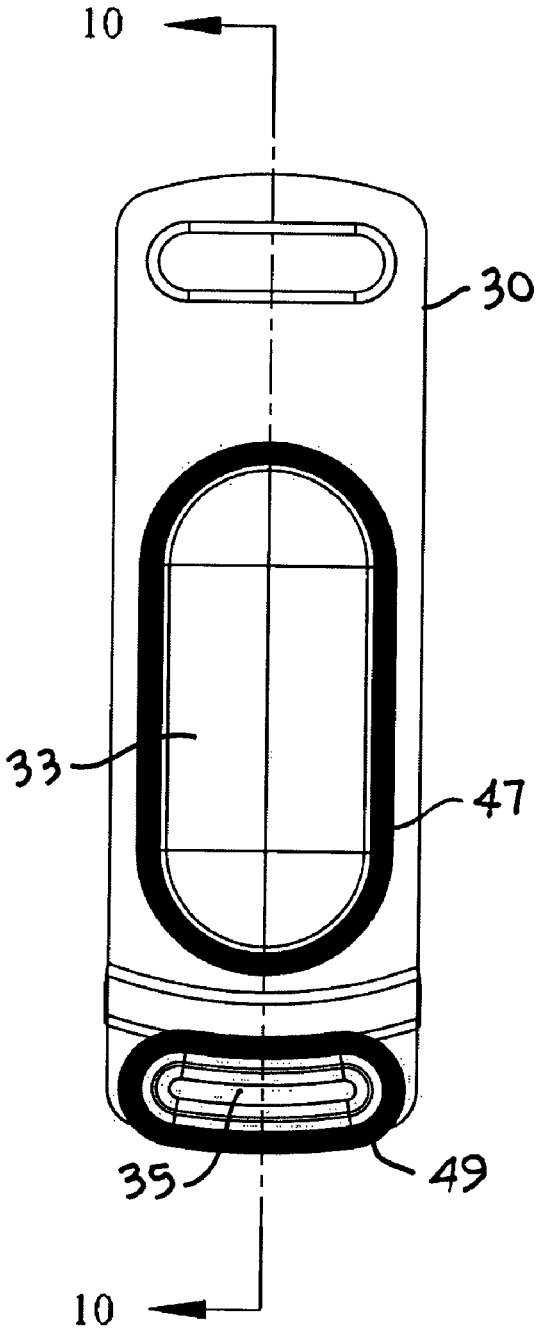
FIG. 9 is a top diagrammatical view of the flexible closure tab of FIG. 2 showing the placement of optional oval gaskets.
Figure 10:
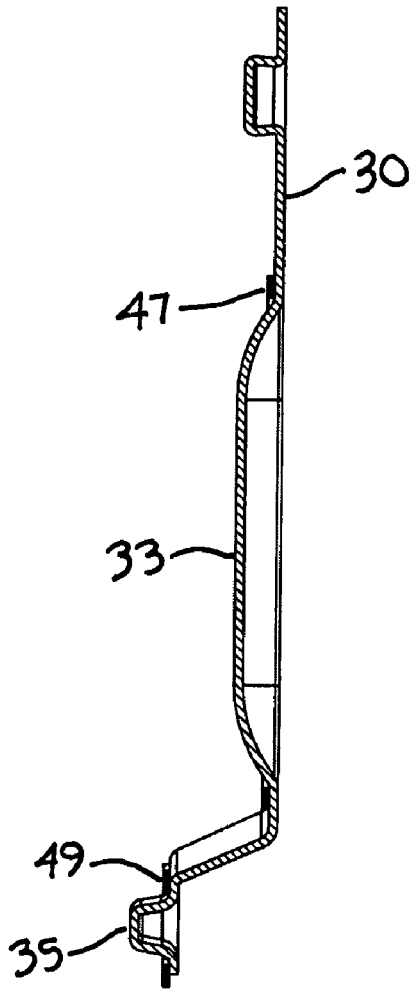
FIG. 10 is a section view of the closure tab of FIG. 9.

In an alternative exemplary embodiment, shown in FIGS. 9-10, the flexible closure tab 30 may include an actuator oval gasket 47 enclosing the opening actuator 33, and a closure oval gasket 49 enclosing the lid opening closure 35. The actuator oval gasket 47 and the closure oval gasket 49 may be fabricated from a resilient material, where the gasket thicknesses are a function of the particular application for the anti-splash/spill container lid 10. As can be appreciated by one skilled in the relevant art, the pourable substance 14 functions to compress the actuator oval gasket 47 and the closure oval gasket 49 when the container 12 is inadvertently tipped, thus providing a more positive seal against spillage or leakage.

Figure 11:
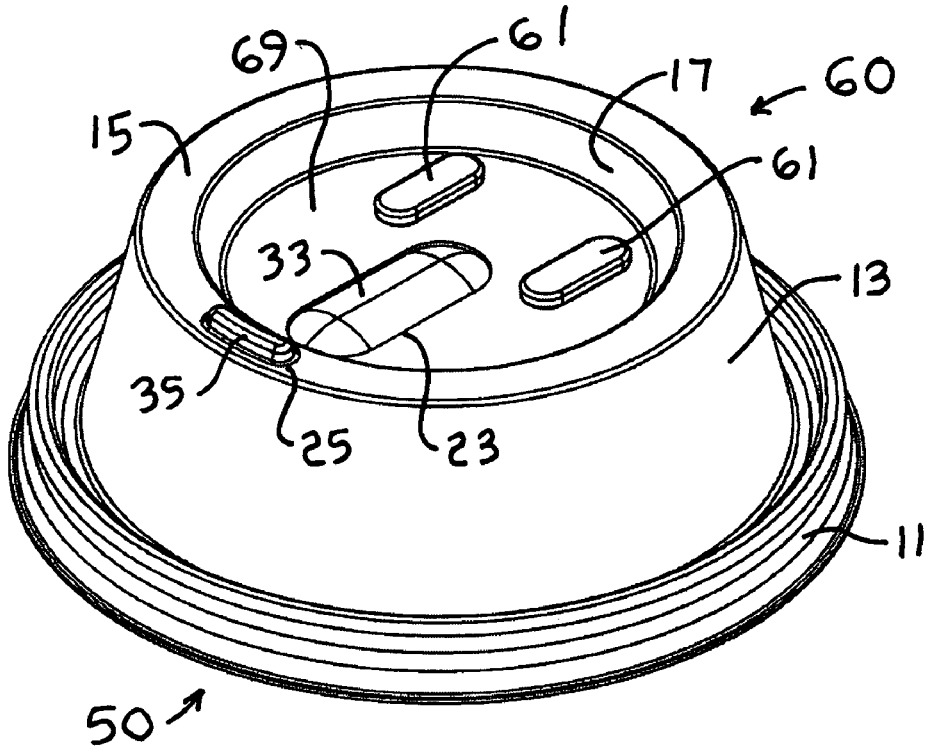
FIG. 11 is a diagrammatical isometric view of an alternative exemplary embodiment of a two-piece anti-splash/spill container lid and flexible closure tab, in accordance with the present invention.

In yet another exemplary embodiment, shown in FIG. 11, a two-piece anti-splash/spill container lid 50 comprises a lid base 60 and a flexible closure tab 70, in accordance with the present invention. The lid base 60 comprises the concave lid rim 11, the outer conical surface 13, the inner conical surface 17, the top ridge 15 extending between the inner conical surface 17 and the outer conical surface 13, and a depressed interior surface 69. The anti-splash/spill container lid 50 may, in an alternative embodiment, comprise the outer torroidal surface 13*a* (not shown) in place of the outer conical surface 13, and may comprise the domed interior surface 19*a* (not shown) in place of the depressed interior surface 69. The lid base 60 further includes two snap receptacle 61 disposed on the depressed interior surface 69 adjacent the actuator guide cutout 23. The lid opening 25 is provided in the top ridge 15 to allow for dispensing of the pourable substance 14.

Figure 12:
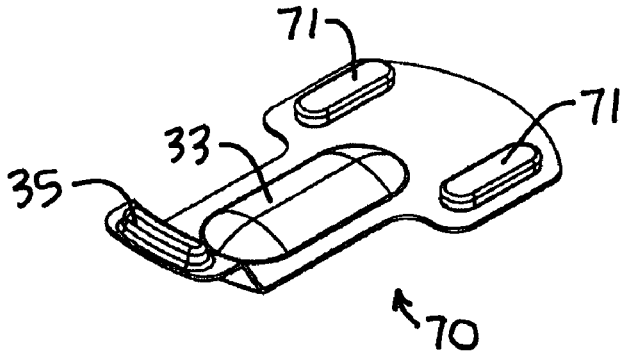
FIG. 12 is a diagrammatical isometric view of the flexible closure tab of FIG. 11 showing two snaps.
Figure 13:
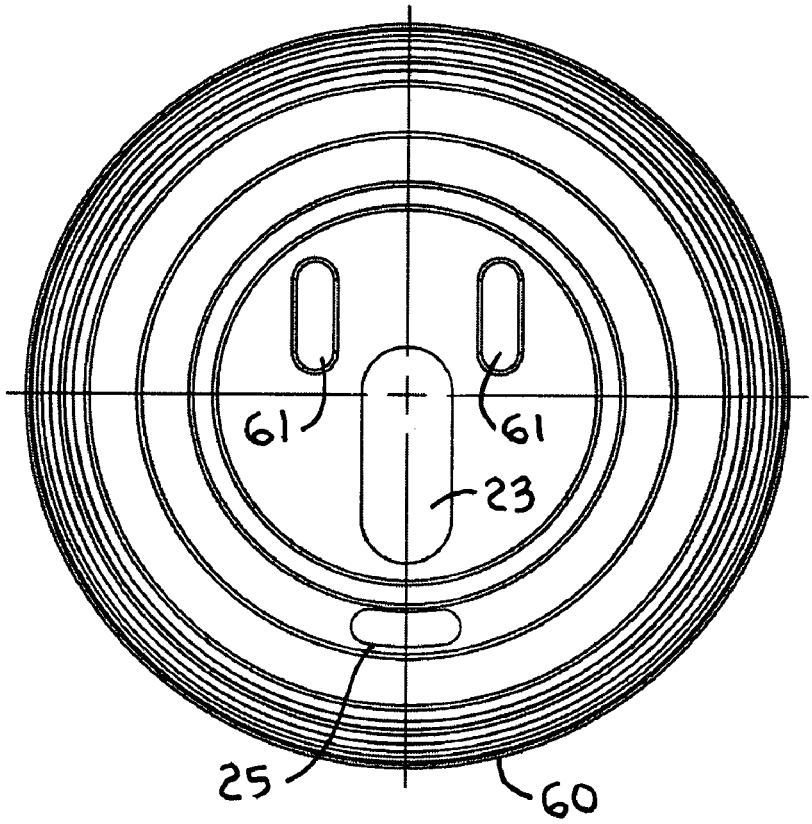
FIG. 13 is a diagrammatical top view of the container lid of FIG. 11.

As best shown in FIGS. 12 and 13, two snaps 71 functioning as hinge or pivot regions are disposed at an attachment section 75 of the flexible closure tab 70 for insertion into and retention by the two snap receptacles 61. The flexible closure tab 30 further includes the opening actuator 33 protruding from a central cantilever section 77, and includes the lid opening closure 35 disposed at the offset section 39 in the closure tab 70, distal from the snaps 71. When the snaps 71 are releasably secured in the corresponding snap receptacles 61, the opening actuator 33 protrudes through the actuator guide cutout 23 of the container lid 50, and the lid opening closure 35 protrudes through and closes off the lid opening 25. The retention of the snaps 71 in the corresponding snap receptacles 61 is similar to the configuration shown in FIG. 6 for the container lid 10. In an alternative embodiment (not shown for clarity of illustration), the flexible closure tab 70 may comprise either or both the actuator oval gasket 47 and the closure oval gasket 49.

Figure 15:
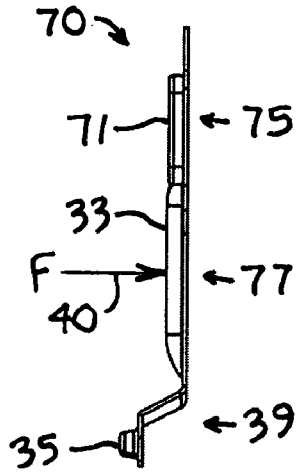
FIG. 15 is a diagrammatical side view of the flexible closure tab of FIG. 14.

Operation of the container lid 50 is similar to operation of the container lid 10 described above. When the actuating force F, indicated by the arrow 40, is applied to the opening actuator 33 located on the closure tab 70, as shown in FIG. 15, the flexible closure tab 70 flexes at the pivot region proximate the snaps 71 and the central cantilever section 77 moves downward into the container 12 whereby the lid opening closure 35 is removed from the lid opening 25. When the actuating force F is removed from the opening actuator 33, the spring-like biasing force of the closure tab 70 causes the lid opening closure 35 to re-close the lid opening 25 in the lidbase 60.

Figure 14:
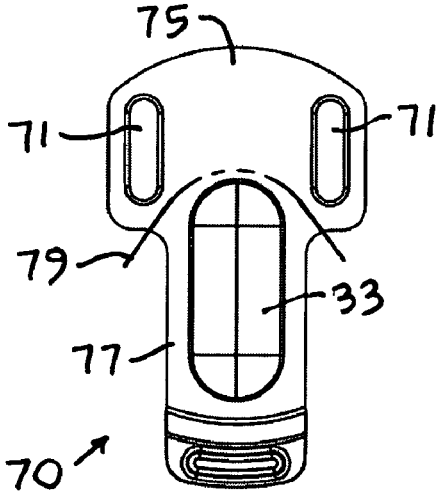
FIG. 14 is a diagrammatical top view of the flexible closure tab of FIG. 12, showing a curved bend line.

The two snaps 71 are in spaced-apart relationship on the attachment section 75 of the closure tab 70 as shown in FIG. 14. As can be seen, a portion of the opening actuator 33 is disposed on the cantilever section 77, and a portion of the opening actuator 33 extends into the attachment section 75 at the pivot region of the flexible closure tab 70. When the actuating force F is applied to the opening actuator 33, the closure tab 70 flexes in a region lying between the attachment section 75 and the cantilever section 77. In particular, the closure tab 70 forms a curved bend line 79, partially located in the snap base section 75 and extending between the two snaps 71 and the opening actuator 33. The curved bend line 79 is nonlinear because of the relative geometric locations of the snaps 71 and the opening actuator 33.

As understood by one skilled in the relevant art, application of the actuating force F results in a bending of the flexible closure tab 70 at the curved bend line 79 and produces a biasing force reacting to the force F so as to "straighten out" the flexible closure tab 70. Because the curved bend line 79 is curved and not linear, application of the actuating force F produces additional torsion forces arising normal to the curved bend line 79 between the opening actuator 33 and the snaps 71, and arising at the portion of the opening actuator extending into the base section 75. Accordingly, the total biasing force produced by the flexible closure tab 70 bending along the curved bend line 79 is greater than the biasing force produced by bending the otherwise physically similar flexible closure tab 30 of the container lid 10, described above. The closure tab configuration shown in FIG. 10 may be particularly useful for anti-splash/spill applications requiring a moderate closure force.

Figure 16:
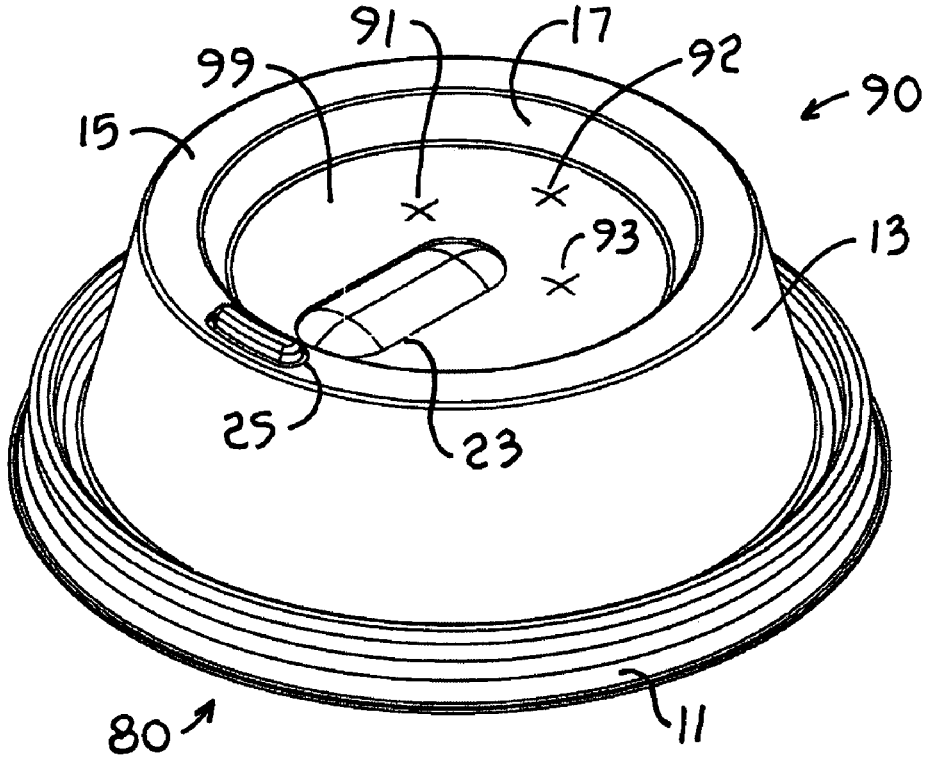
FIG. 16 is a diagrammatical isometric view of yet another alternative exemplary embodiment of a two-piece anti-splash/spill container lid and flexible closure tab, in accordance with the present invention.
Figure 17:
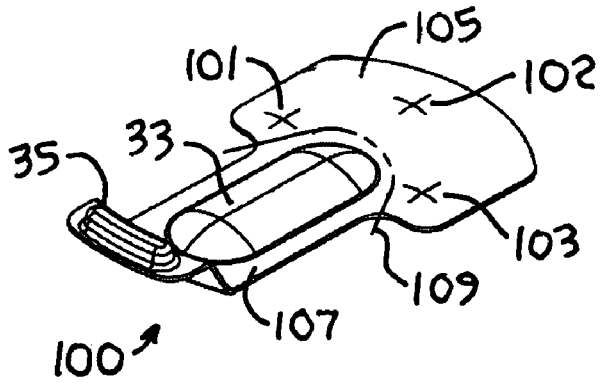
FIG. 17 is a diagrammatical isometric view of the closure tab of FIG. 16 showing tab deformations produced by tack welding and a curved bend line.

In yet another alternative exemplary embodiment of an anti-splash/spill container lid, shown in FIGS. 16-17, a two-piece container lid 80 comprises a lid base 90 and a flexible closure tab 100, in accordance with the present invention. The lid base 90 comprises the concave lid rim 11, the outer conical surface 13, the inner conical surface 17, the top ridge 15 extending between the inner conical surface 17 and the outer conical surface 13, and a depressed interior surface 99. The lid base 90 includes the actuator guide cutout 23 in the central interior surface 99, and includes the lid opening 25 in the top ridge 15. The lid 80 is similar to the lid 50, above, with the differences that: (i) the lid base 90 does not include snap receptacles, and (ii) the flexible closure tab 100 does not include snaps.

The flexible closure tab 100 may be permanently attached to the lid base 90 by means of tack welds, adhesive, mechanical fasteners, heat staking, swaging, hydroforming, or other attachment means known in the art. In the example provided, three tack welds are used, as represented by lid deformations 91, 92, and 93, and corresponding tab deformations 101, 102, and 103. The closure tab 100 further comprises the opening actuator 33 protruding from a cantilever section 107, and includes the lid opening closure 35 disposed at an end of the flexible closure tab 100 distal from the tab deformations 101-103. The opening actuator 33 protrudes through the actuator guide cutout 23 of the lid base 90, and the lid opening closure 35 protrudes through the lid opening 25.

Operation of the container lid 80 is similar to operation of the container lid 10 described above. When the actuating force F (not shown) is applied to the opening actuator 33 located on the flexible closure tab 100, the closure tab 100 flexes at a pivot region proximate the tab deformations 101-103, and the lid opening closure 35 moves downward into the container 12 to expose the lid opening 25. When force F is removed from the opening actuator 33, the spring-like biasing force of the flexible closure tab 100 causes the lid opening closure 35 to re-close the lid opening 25 in the lid 80.

The tab deformations 101-103 are in spaced-apart relationship, defining a substantially triangular region on an attachment section 109 of the flexible closure tab 100. The opening actuator 33 is disposed on the cantilever section 107 with a portion of the opening actuator 33 extending into the attachment section 109. That is, part of the opening actuator 33 extends between the tab deformations 101 and 103. When the actuating force F is applied to the opening actuator 33, the closure tab 100 flexes at the pivot region proximate the tab deformations 101 and 103. The closure tab 100 thus forms a curved bend line 109 between the opening actuator 33 and an imaginary line extending between the tab deformations 101 and 103, the curved bend line 109 being similar to the curved bend line 79 shown in FIG. 14, described above. Accordingly, by extending the opening actuator 33 into the region between the tab deformations 101 and 103, the flexible closure tab 100 bends along a curved bend line and, accordingly, exhibits a greater spring-like biasing force than if a straight bend line was present.

Figure 18:
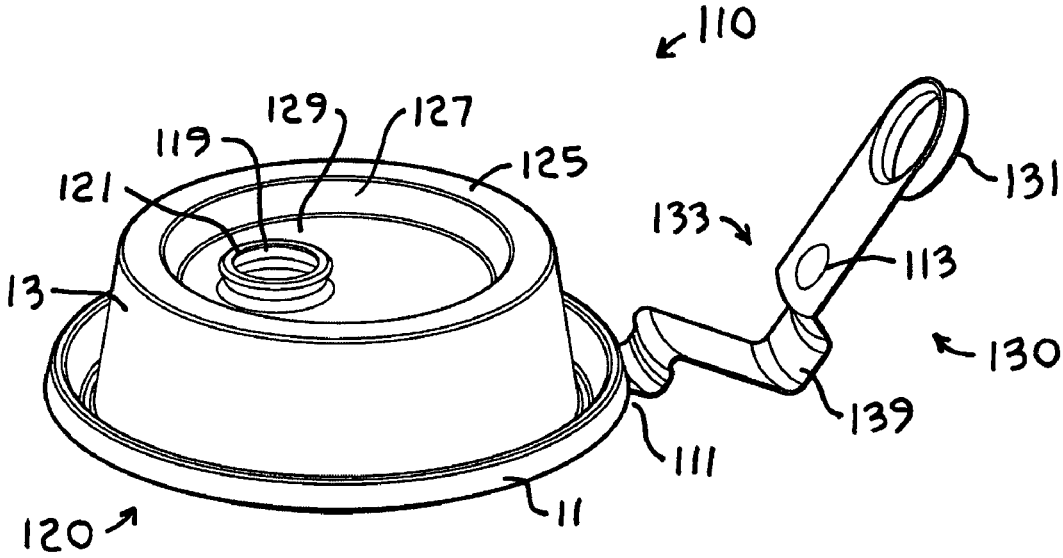
FIG. 18 is a diagrammatical isometric view of an exemplary embodiment of a one-piece anti-splash/spill container lid with hinged closure tab, in accordance with the present invention.
Figure 19:
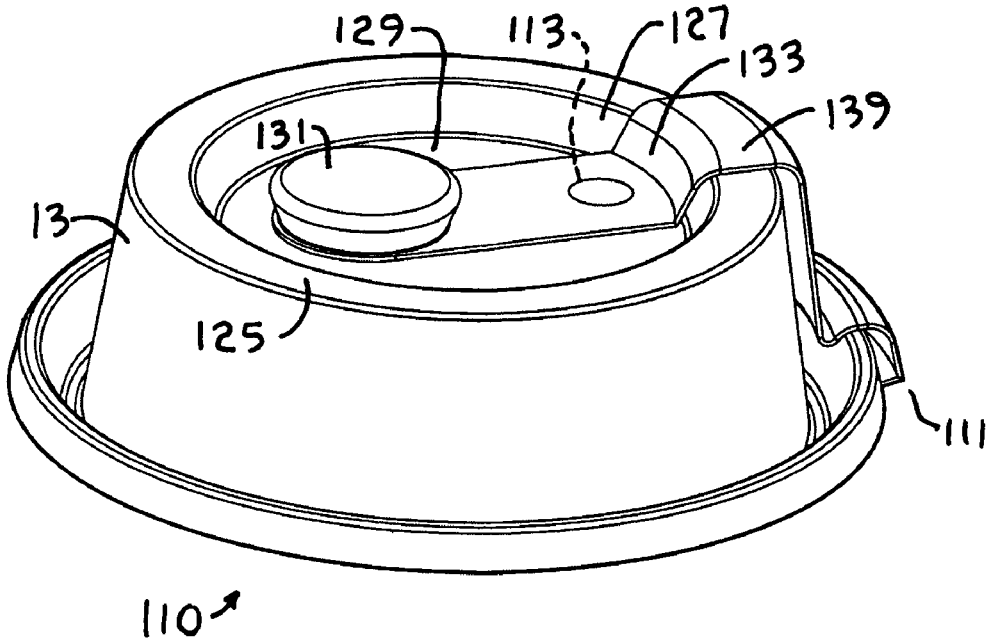
FIG. 19 is a diagrammatical isometric view of the container lid of FIG. 18 with the hinged closure tab in a closed position.
Figure 20:
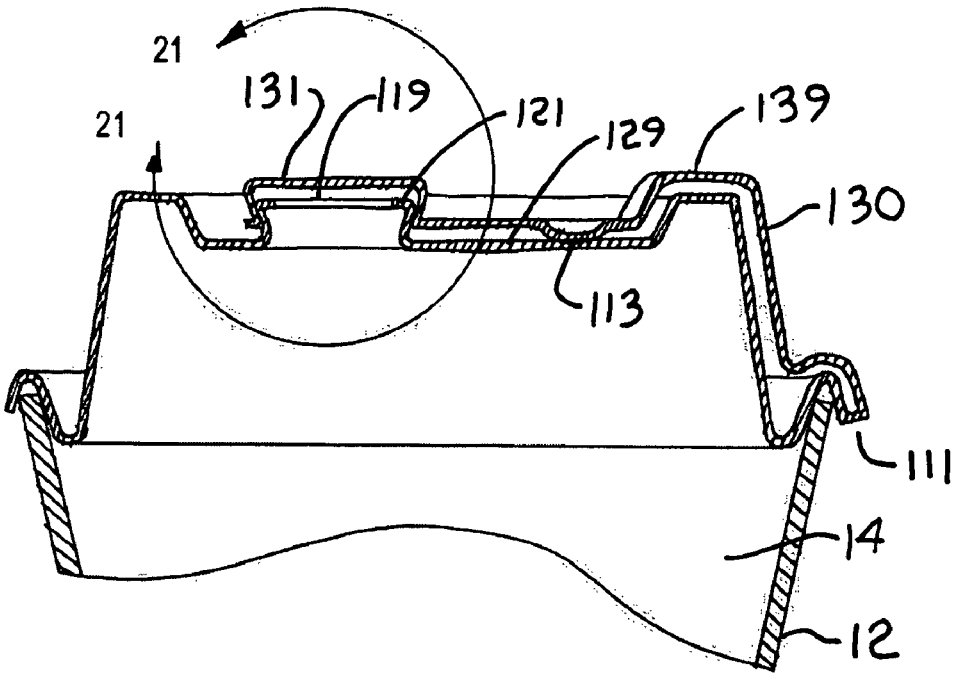
FIG. 20 is a cross sectional view of the container lid of FIG. 19.

There is shown in FIGS. 18 and 19 an exemplary embodiment of a one-piece anti-splash/spill container lid 110 comprising a lid base 120 and a hinged closure tab 130. The lid base 120 comprises the concave lid rim 11, the outer conical surface 13, an inner conical surface 127, a top ridge 125 extending between the inner conical surface 127 and the outer conical surface 13, and a depressed interior surface 129. The depressed interior surface 129 includes a lid opening 119 in an oval or circular lid mesa 121 for allowing an outflow of the pourable substance 14 from the container 12 (shown in FIG. 18). The hinged closure tab 130 may be integrally formed with the lid base 120 at the concave lid rim 11, thus providing a means for the hinged closure tab 130 to bend at a container hinge 111. The hinged closure tab 130 includes a tab arm 133 with a tab hinge 139, and an oval or round actuator cap 131 attached to the tab arm 133. The tab arm 133 includes a pivot boss 113 disposed between the actuator cap 131 and the tab hinge 139. As shown in FIG. 19 and in the cross sectional view of FIG. 20, the pivot boss 113 contacts the depressed interior surface 129 when the hinged closure tab 130 is folded at the tab hinge 139 and the container hinge 111, and rotated onto the lid base 120. This placement then allows the actuator cap 131 to cover the lid mesa 121 and close off the lid opening 119.

Figure 21:
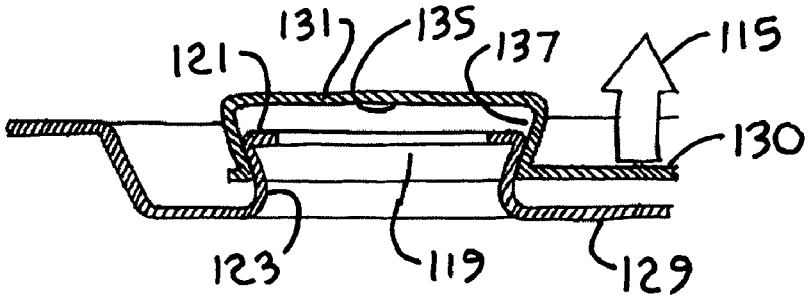
FIG. 21 is an enlarged detail of the cross sectional view of FIG. 20 showing an actuator cap in a closed position.
Figure 22:
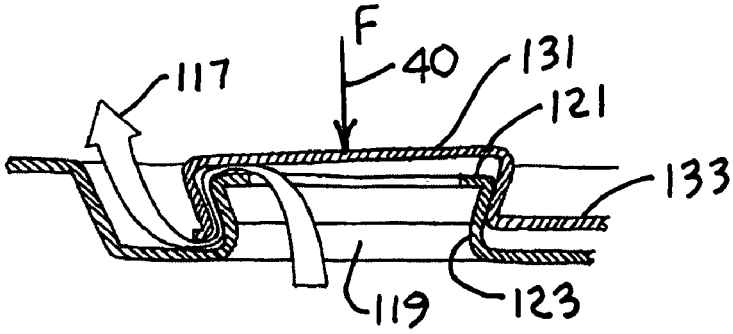
FIG. 22 is a view of the actuator cap of FIG. 21 in an opened position.

As best seen in the detail views of FIGS. 21 and 22, the actuator cap 131 comprises an actuator interior surface 135 and an actuator interior wall 137 having a substantially truncated conical shape. The lid mesa 121 comprises a mesa periphery wall 123 having a truncated conical shape substantially congruent to the actuator interior wall 137. In FIG. 21, the hinged closure tab 130 is shown in a non-actuated state wherein the actuator cap 131 is biased away from the depressed interior surface 129, as indicated by arrow 115. The upward bias results from the forced placement of the pivot boss 113 against the depressed interior surface 129. The mesa periphery wall 123 is sized and shaped to provide a "press fit" with the actuator interior wall 137 when the actuator cap 131 is biased away from the depressed interior surface 129. Accordingly, both the actuator interior surface 135 and the press fit configuration of the actuator internal wall 137 against the mesa periphery wall 123 serve to provide a seal against the pourable substance 14 splashing or passing out of the container 12 through the lid opening 119.

The user (not shown) may apply the actuating force F, indicated by the arrow 40, to the actuator cap 131, as shown in FIG. 22, to open a path for the pourable substance 14 to flow out of the container 12 through the lid opening 119, as indicated by arrow 117. When the user removes the actuating force F from the actuator cap 131, the biasing force of the pivot boss 113 against the depressed interior surface 129 returns the hinged closure tab 130 to the position shown in FIG. 21.

Figure 23:
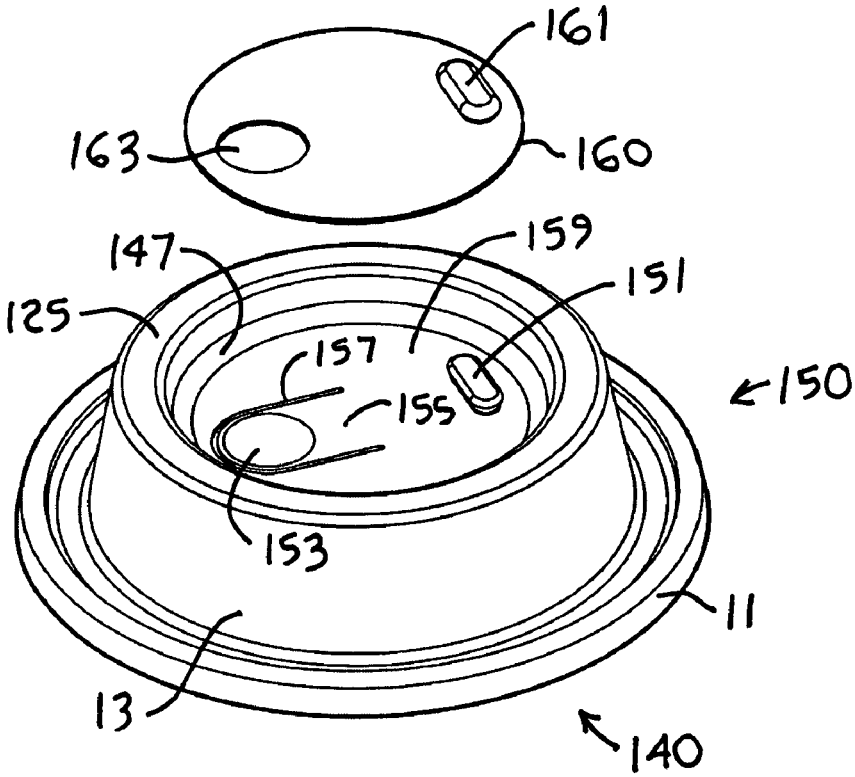
FIG. 23 is an exploded diagrammatical isometric view of another exemplary embodiment of a two-piece anti-splash/spill container lid and flexible closure tab, in accordance with the present invention.
Figure 24:
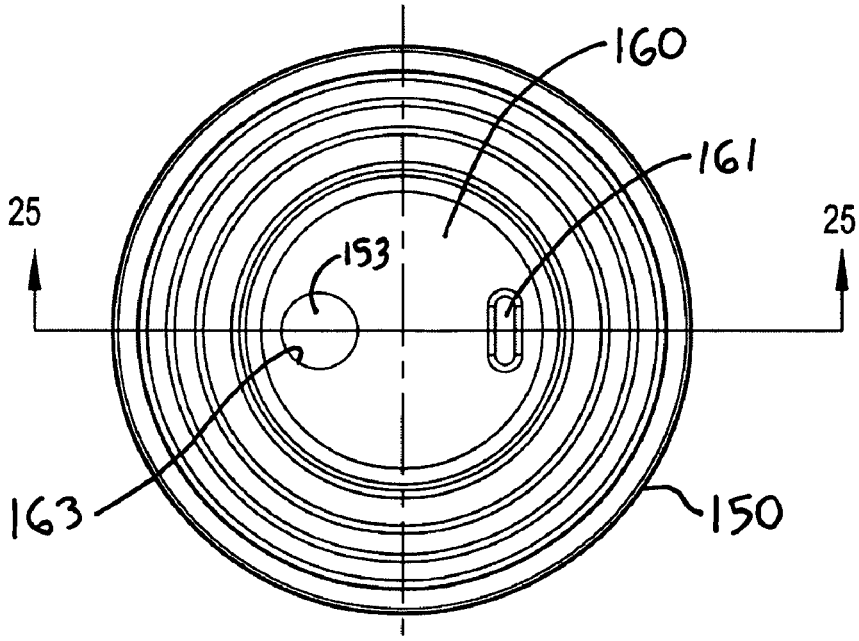
FIG. 24 is a top view of the container lid of FIG. 23.

There is shown in FIGS. 23 and 24 an exemplary embodiment of a two-piece anti-splash/spill container lid 140 comprising a lid base 150 and an actuator disk 160. The lid base 150 comprises the concave lid rim 11, the outer conical surface 13, an inner conical surface 147, the top ridge 125 extending between the inner conical surface 147 and the outer conical surface 13, and a depressed interior surface 159. The depressed interior surface 159 includes a base snap 151 and a domed lid opening closure 153 disposed thereupon. The domed lid opening closure 153 is preferably configured as a generally hemispherical surface attached to the depressed interior surface 159 by a cantilever arm 155. A U-shaped through cut 157 allows the domed opening closure 153 and the cantilever arm 155 to move with respect to the depressed interior surface 159.

The actuator disk 160 comprises a generally planar disk having a snap receptacle 161 thereupon and a substantially circular actuator opening 163 therethrough. The actuator disk 160 is configured to generally conform with the depressed interior surface 159 in the lid base 150. The snap receptacle 161 is configured to releasably mate with the base snap 151. The actuator opening 163 is configured and positioned such that, when the snap receptacle 161 is mated to the base snap 151, the actuator opening 163 is approximately centered upon and substantially encloses the domed lid opening closure 153. The diameter of the actuator opening 163 is preferably smaller than the diameter of the domed lid opening closure 153 at the plane of the cantilever arm 155.

Figure 25:
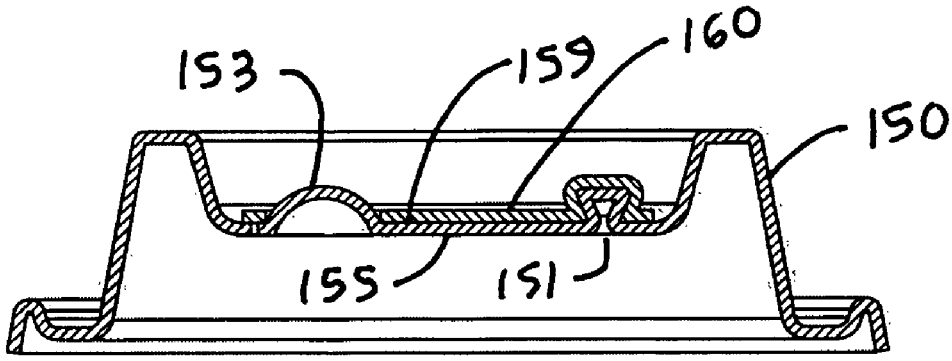
FIG. 25 is a cross sectional view of the container lid and flexible closure tab of FIG. 23 showing a closed lid opening.
Figure 26:
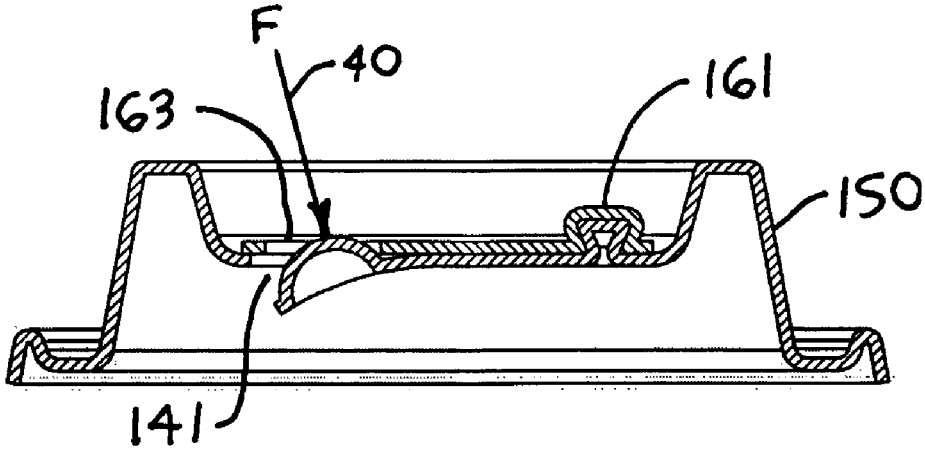
FIG. 26 is a cross sectional view of the container lid and flexible closure tab of FIG. 23 showing an opened lid opening.

As can be best seen in the cross-sectional view of FIG. 25, the actuator disc 160 is disposed upon the depressed interior surface 159 so as to allow the domed lid opening closure 153 to protrude through the actuator opening 163. Upon application of the actuating force F to the domed lid opening closure 153, the cantilever arm 155 bends below the depressed inner surface 159. This action produces a lid opening 141 in the lid base 150, as shown in FIG. 26. The lid opening 141 is generally coextensive with the actuator opening 163, which combination allows the passage of the pourable substance 14 therethough.

Figure 27:
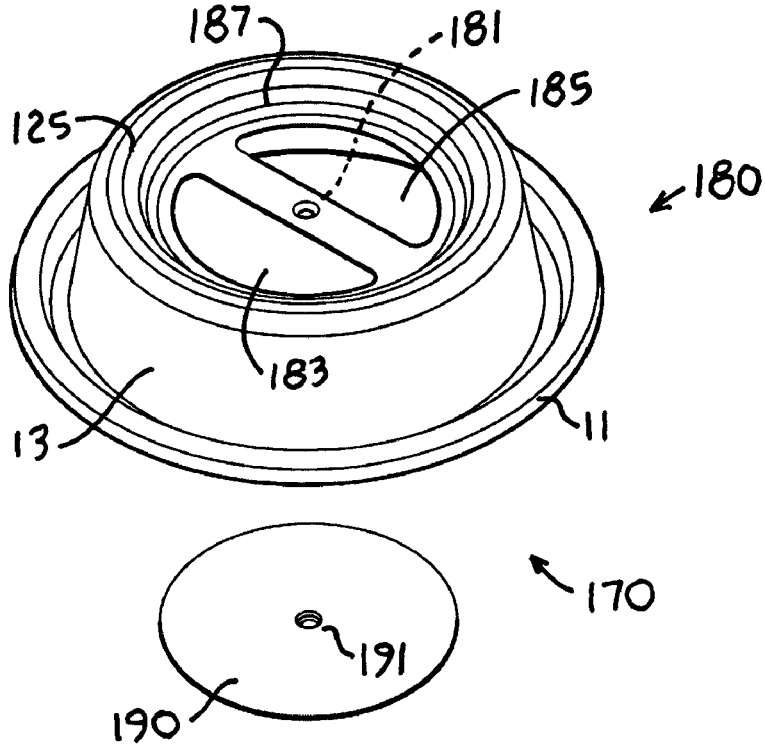
FIG. 27 is an exploded diagrammatical isometric view of an exemplary embodiment of a two-piece anti-splash/spill container lid and flexible disk-shaped closure member, in accordance with the present invention.
Figure 28:
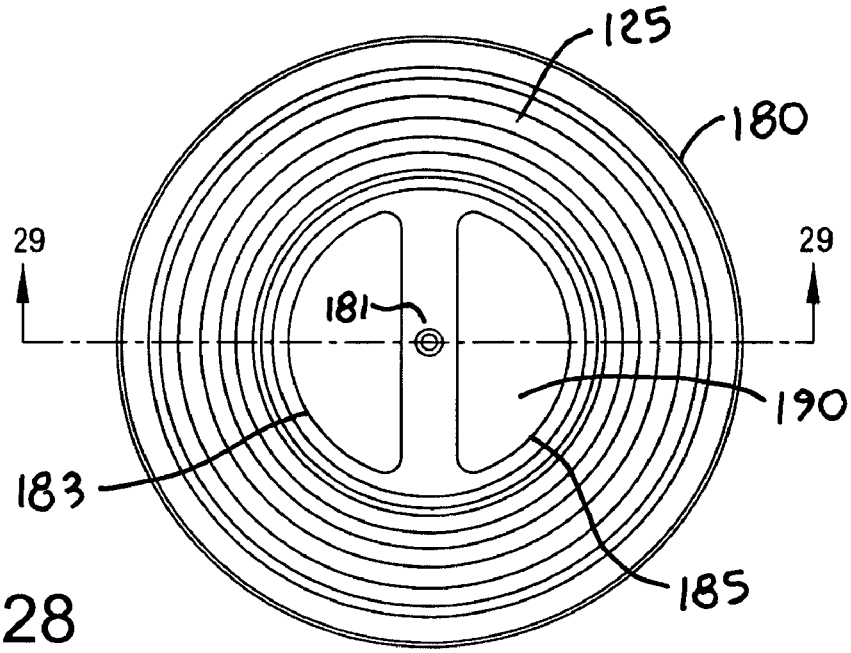
FIG. 28 is a top view of the container lid of FIG. 27.

In another exemplary embodiment, shown in FIGS. 27 and 28, a two-piece anti-splash/spill container lid 170 comprises a lid base 180 and a flexible, closure disk 190. The lid base 180 comprises the concave lid rim 11, the outer conical surface 13, an inner conical surface 187, the top ridge 125 extending between the inner conical surface 187 and the outer conical surface 13, and a protruding snap 181 which releasably mates with a snap receptacle 191 in the closure disk 190. The lid base 180 further includes first and second semi-circular openings 183 and 185. When the container lid 170 is in a non-actuated state, the closure disk 190 is disposed against the lid base 180 so as to prevent the pourable substance 14 from passing through either the first semi-circular opening 183 or the second semicircular opening 185.

Figure 29:
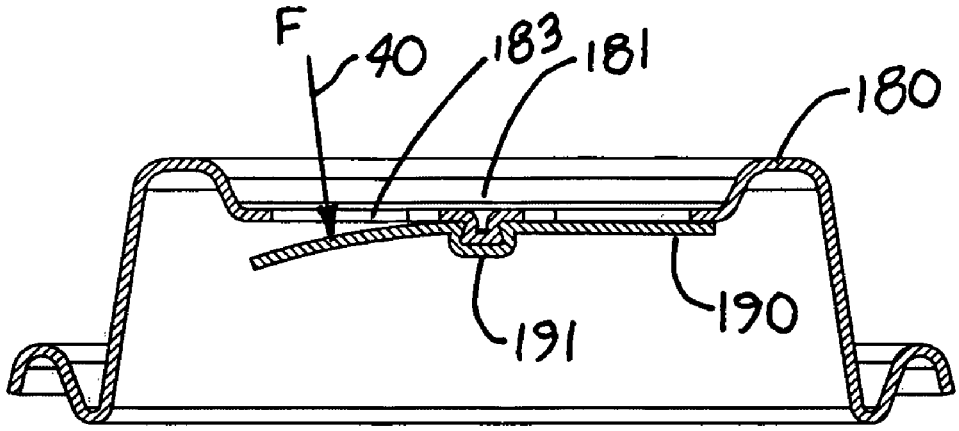
FIG. 29 is a cross sectional view of the assembled container lid of FIG. 27 showing the disk-shaped closure member opened to dispense liquid.
Figure 30:
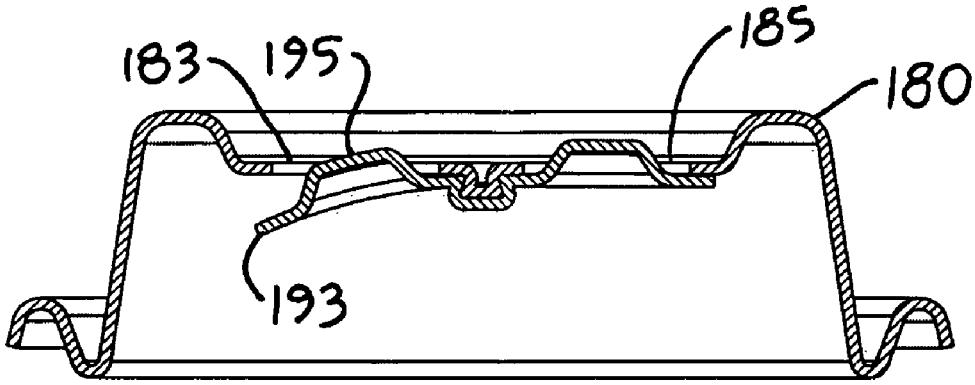
FIG. 30 is an alternative embodiment of the container lid of FIG. 27 having a disk-shaped closure member with a dome-shaped actuation surface.

When the user applies the force F, as indicated by the arrow 40 in FIG. 29, to the closure disk 190 through the first semicircular opening 183, for example, the force F causes the closure disk 190 to deform or bend away from the first semicircular opening 183 and allow the pourable substance 14 to flow through the first semi-circular opening 183. In an alternative embodiment, the lid base 180 may include only the first semi-circular opening 183. In yet another alternative exemplary embodiment, shown in FIG. 30, a domed closure disk 193 may be configured to include one or two dome-shaped actuation surfaces 195 protruding through one or both the first semi-circular opening 183 and the second semicircular opening 185 to provide for a larger opening in the container lid 180.

It is to be understood that the description herein is exemplary of the invention only and is intended to provide an overview for the understanding of the nature and character of the invention as it is defined by the claims. The accompanying drawings are included to provide a further understanding of various features and embodiments of the method and apparatus of the invention which, together with their description serve to explain the principles and operation of the invention. Thus, as stated above, while the invention has been described with reference to particular embodiments, it will be understood that the present invention is by no means limited to the particular constructions and methods herein disclosed and/or shown in the drawings, but also comprises any modifications or equivalents within the scope of the claims. Further, the purpose of the Abstract is to enable the U.S. Patent and Trademark Office, the public generally, and in particular practitioners in the art who are not familiar with patent or legal terms or phraseology, to determine from a cursory inspection the nature and essence of the technical disclosure of the application. Accordingly, the Abstract is not intended to define nor limit the claims in any way.

What is claimed is:

1. A container lid comprising:
- a flexible closure tab having
  - a snap;
  - a lid opening closure;
  - an opening actuator protruding from a planar cantilever section of said flexible closure tab between said snap and said lid opening closure;
- a lid base having;
  - a snap receptacle for releasably retaining said snap;
  - a lid opening for receiving said lid opening closure; and
  - an actuator guide cutout through said lid base for allowing said opening actuator to protrude through said lid base.

2. The container lid according to claim 1 wherein said flexible closure tab further comprises an offset section including an offset base attached to an offset arm such that said offset base is offset from and substantially parallel to said cantilever section, said lid opening closure disposed on said offset base.

3. The container lid according to claim 1 wherein said opening actuator comprises a substantially convex surface protruding from said cantilever section.

4. The container lid according to claim 1 wherein said lid base further comprises:
- a generally planar, substantially circular, depressed interior surface having said snap receptacle disposed thereupon and having said actuator guide cutout extending therethrough;
- a top ridge having said lid opening extending therethrough; and
- an inner conical surface connecting said interior surface and said top ridge, said inner conical surface having the general shape of a truncated cone.

5. The container lid according to claim 1 further comprising:
- a second snap receptacle disposed on said lid base; and
- a second snap disposed on said flexible closure tab, said second snap releasably retained by said second snap receptacle.

6. The container lid according to claim 5 wherein a portion of said opening actuator extends into an attachment section lying between said snaps.

7. A container lid comprising:
- a flexible closure tab having
  - a lid opening closure disposed on said flexible closure tab;
  - an opening actuator protruding from said flexible closure tab proximate said lid opening closure;
- a lid base having
  - a top ridge extending between an outer conical surface and an inner conical surface, said inner conical surface enclosing a generally planar, substantially circular, depressed interior surface;
  - means for securing a second end of said flexible closure tab to an underside of said depressed interior surface;
  - a lid opening in said top ridge for receiving said lid opening closure; and
  - an actuator guide cutout through said depressed interior surface for allowing said opening actuator to protrude through said lid base;
- whereby said lid opening closure may be moved from said lid opening by application of a depressing force to said opening actuator.

8. The container lid according to claim 7 wherein said means for securing comprises any of: tack welds, adhesive, mechanical fasteners, heat staking, swaging, hydroforming, or snap with snap receptacle.

9. The container lid according to claim 7 wherein said flexible closure tab comprises an offset base attached to an offset arm such that said lid opening closure is offset from and substantially parallel to said opening actuator.

10. The container lid according to claim 7 wherein said means for securing is configured such that application of said depressing force to said opening actuator causes said flexible closure tab to bend along a curved bend line lying on said depressed inner surface between said opening actuator and said means for securing.

11. The container lid according to claim 7 further comprising at least one oval gasket, said at least one oval gasket enclosing one of said opening actuator and said lid opening closure.

12. A method for dispensing a pourable substance through a container lid, said method comprising the steps of:

providing a lid opening closure for a lid opening, said lid opening disposed in a top ridge of the container lid;

providing an opening actuator mechanically coupled to said lid opening closure, said opening actuator including a substantially convex surface protruding through an actuator guide cutout in a generally planar, substantially circular, depressed interior surface in the container lid;

providing a pivot point mechanically coupled to said opening actuator; and applying a depressing actuating force to said opening actuator to move said lid opening closure into the container.

13. The method according to claim 12 wherein said step of applying comprises the step of bending a flexible closure proximate said pivot point, said flexible closure providing cantilever support to said lid opening closure.

14. The method according to claim 13 wherein said step of bending comprises the step of bending said flexible closure along a curved bend line.

* * * * *